US005221073A

United States Patent [19]

Shockley

[11] Patent Number: 5,221,073

[45] Date of Patent: Jun. 22, 1993

[54] SAFETY FLOOR JACK

[76] Inventor: James D. Shockley, 26 Harbor Dr., Greenville, S.C. 29611

[21] Appl. No.: 915,009

[22] Filed: Jul. 15, 1992

Related U.S. Application Data

[63] Continuation-in-part of Ser. No. 656,980, Feb. 19, 1991, abandoned.

[51] Int. Cl.[5] ..... B66F 5/04

[52] U.S. Cl. ..... 254/8 B

[58] Field of Search ..... 254/2 B, 2 R, 8 B, 8 R, 254/124, 88, 133 R

[56] References Cited

U.S. PATENT DOCUMENTS 2,076,069 4/1937 Davis ..... 254/88
2,695,768 11/1954 Lucker ..... 254/133 R
2,814,394 11/1957 Witcher ..... 254/8 B
3,759,488 9/1973 Lukas .
3,783,983 1/1974 McNally et al. .

FOREIGN PATENT DOCUMENTS 2429742 1/1980 France ..... 254/8 B
1248261 9/1971 United Kingdom ..... 254/8 B

*Primary Examiner*—Robert C. Watson
*Attorney, Agent, or Firm*—Hardaway Law Firm

[57] ABSTRACT

A floor jack is provided with safety means to prevent arms of the jack from retracting while the arms are in a raised position. This safety means is insertable through opposing pairs of notches in the side plates of the floor jack, these notches being aligned opposite from one another.

4 Claims, 1 Drawing Sheet

SAFETY FLOOR JACK

CROSS REFERENCE TO RELATED APPLICATIONS

This application is a Continuation-In-Part application of application Ser. No. 07/656,980 filed Feb. 19, 1991, now abandoned.

BACKGROUND OF THE INVENTION

This invention relates generally to floor jacks and more particularly to a floor jack with a safety feature to prevent the jack from retracting while it is in a raised position.

The use of floor jacks is common, and various designs of floor jacks exist within the prior art. It is highly desirable to prevent such floor jacks from retracting while in a raised position, since failure of a jack in a raised position could cause great harm, possibly even fatal, to persons using such floor jacks. It is common for floor jacks to be operated by hydraulic means, and safety means are therefore highly desirable to prevent hydraulic floor jacks from retracting in the event that the hydraulics fail while a jack is in a raised position.

U.S. Pat. No. 3,783,983 discloses a safety brake system for hydraulic jack lifts such as those used to lift automobiles completely off the ground for service underneath. U.S. Pat. No. 3,759,488 discloses a rolling hydraulic jack which includes a safety means to prevent retraction of the jack shaft. This safety means comprises a propping block with a spring means for automatically forcing the block into a fixed propping position.

While the prior art discloses safety means for hydraulic jacks, there exists much room for safety improvement with hydraulic floor jacks.

SUMMARY OF THE INVENTION

It is therefore an object of the present invention to provide a hydraulic floor jack with safety means.

It is another object of the present invention to provide such a safety floor jack wherein such safety means may be adjustably positioned to provide varying height levels of safety assurance.

These as well as other objects are accomplished by a hydraulic floor jack including a safety means to prevent the arms of the jack from retracting while they are in a raised position. This safety means is insertable through opposing pairs of notches in the side plates of the floor jack, these notches being aligned opposite from one another.

DETAILED DESCRIPTION

Figures 1, 2:
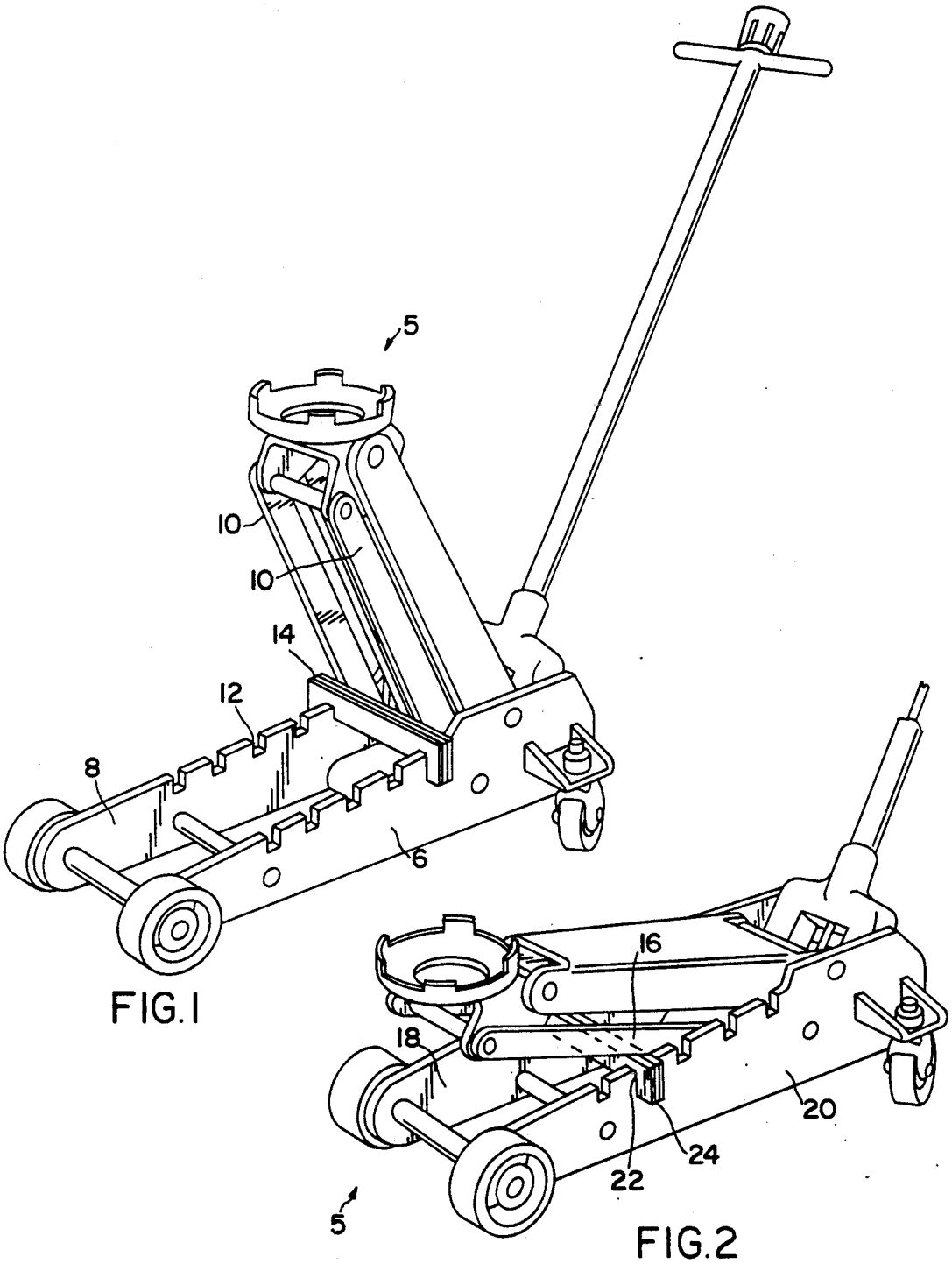
FIG. 1 is a perspective view of a hydraulic floor jack with safety means in accordance with the present invention.
FIG. 2 is a perspective view of a hydraulic floor jack with its arms in a different position with safety means in accordance with the present invention.

In accordance with this invention it has been found that a hydraulic floor jack can be provided with safety means to prevent the arms of the jack from retracting while the arms are in a raised position. It has also been found with the present invention that such a safety floor jack can be provided wherein the safety means is adjustably positioned along the floor jack to assure safety protection at varying heights.

As seen in FIG. 1, a safety floor jack 5 according to this invention comprises two side plates 6 and 8. Hydraulically operated arms 10 are mounted to and between side plates 6 and 8. Side plates 6 and 8 define notches 12 along the length of the side plates 6 and 8. The notches 12 are in opposing pairs on side plates 6 and 8 and are aligned opposite from one another. Safety means 14, shown in FIG. 1 as a rod, preferably constructed of steel, is included with the floor jack 5 and is insertable through a pair of notches 12 simultaneously positioned perpendicular to and between the side plates 6 and 8. This configuration enables the safety means 14 to prevent the arms 10 from retracting while the arms 10 are in a raised position as shown in FIG. 1.

FIG. 2 illustrates a safety floor jack 5 according to this invention with the hydraulic arms 16 in a different position than that as depicted in FIG. 1, as the arms 16 are shown in a partially raised position. Once again, side plates 18 and 20 define notches 22 that exist in opposing pairs on side plates 18 and 20, with the notches 22 being aligned opposite from one another. Safety means 24 is shown as a rod, preferably constructed of steel. As shown, this safety means 24 is inserted through a pair of notches 22 so as to prevent the arms 16 from retracting while the arms 16 are in a partially raised position.

According to this invention, safety means 24 is insertable through any one side of a pair of notches 22 that best provides support to the arms 16 in the event the hydraulic arms 16 fail to operate properly.

An advantage of the present invention is that the manually inserted safety means avoids problems associated with automatically engaging pawl and ratchet type safety means of floor jacks. Such jacks continuously engage and wear the associated teeth and notches of the safety means. Further, such safety means requires a biasing mechanism which is itself subject to wear and malfunction.

Manual insertion of the present invention's safety means permits a positive safety lock which is not subject to wear. Further, the present invention does not depend upon springs or other biasing means to engage a safety mechanism. A failure in such a system could go undetected until the malfunction was discovered under emergency conditions.

The present invention provides deeply cut notches within the side plates which enable a near right angle engagement between the structural side plates and the safety means. Such an engagement means and configuration substantially eliminate problems associated with failures in hydraulic floor jacks of the prior art.

It is thus seen that the invention provides a hydraulic floor jack with manually engaged safety means to prevent the arms of the jack from retracting while the arms are in a raised position. It is also seen that the present invention provides such a safety floor jack wherein the safety means can be adjustably positioned along the floor jack. Many variations are apparent to those of skill in the art, and such variations are embodied within the spirit and scope of the present invention as measured by the following appended claims.

That which is claimed:

1. A floor jack comprising:

two side plates;

hydraulically operated arms mounted to and between said side plates;

a group of notches defined by each said side plates, said notches being in opposing pairs on said side plates and said opposing pairs being aligned opposite from one another;

a unitary safety steel rod means to prevent said arms from retracting while said arms are in a raised position;

said steel rod being insertable through any one side of said opposing pairs of notches in said side plates to be simultaneously positioned perpendicular to and between said side plates so as to prevent said arms from retracting while said arms are in a raised position.

2. A floor jack comprising:

two side plates;

hydraulically operated arms mounted to and between said side plates;

a group of notches defined by each said side plates, said notches being in opposing pairs on said side plates and said opposing pairs being aligned opposite from one another.

a unitary safety steel rod means to prevent said arms from retracting while said arms are in a raised position, said safety means separately removable from said side plates and said arms, said safety means being insertable through any one side of said opposing pairs of notches in said side plates to be simultaneously positioned perpendicular to and between said side plates so as to prevent said arms from retracting while said arms are in a raised position.

3. The apparatus according to claim 2 wherein said notches are at near right angles to said side plates.

4. The apparatus according to claim 1 wherein said safety means is manually insertable through any one side of said opposing pairs of notches.

* * * * *